United States Patent [19]

Horgan

[11] 3,953,207

[45] Apr. 27, 1976

[54] COMPOSITE LAYERED PHOTORECEPTOR

[75] Inventor: Anthony M. Horgan, Pittsford, N.Y.

[73] Assignee: Xerox Corporation, Stamford, Conn.

[22] Filed: Oct. 25, 1974

[21] Appl. No.: 517,978

[52] U.S. Cl. ..... 96/1 PC; 96/1.5; 96/68

[51] Int. Cl.[2] ..... G03G 5/04; G03C 1/76

[58] Field of Search ..... 96/1 R, 1.5 R, 1.5 C, 96/68, 1 PC; 252/62.1; 427/13, 26, 145, 152

[56] References Cited

UNITED STATES PATENTS

| | | | |
|---|---|---|---|
| 3,394,001 | 7/1968 | Makino | 96/1.5 |
| 3,573,906 | 4/1971 | Goffe | 96/1 R |
| 3,713,820 | 1/1973 | Champ et al. | 96/1.5 |
| 3,723,110 | 3/1973 | Goffe | 96/1.5 |
| 3,725,058 | 4/1973 | Hayashi et al. | 96/1.5 |
| 3,791,826 | 2/1974 | Cherry et al. | 96/1.5 |

*Primary Examiner*—Douglas J. Drummond
*Attorney, Agent, or Firm*—James J. Ralabate; James P. O'Sullivan; Ronald L. Lyons

[57] ABSTRACT

An imaging member comprising a first layer of electrically active charge transport material contained on a supporting substrate, a photoconductive layer overlaying said active layer, and a second layer of electrically active charge transport material overlaying said photoconductive layer.

8 Claims, 2 Drawing Figures

COMPOSITE LAYERED PHOTORECEPTOR

BACKGROUND OF THE INVENTION

This invention relates in general to xerography and more specifically to a novel photosensitive device and method of use.

In the art of xerography, a xerographic plate containing a photoconductive insulating layer is imaged by first uniformly electrostatically charging its surface. The plate is then exposed to a pattern of activating electromagnetic radiation, such as light, which selectively dissipates the charge in the illuminated areas of the photoconductive insulator while leaving behind a latent electrostatic image in the non-illuminated areas. This latent electrostatic image may then be developed to form a visible image by depositing finely divided electroscopic marking particles on the surface of the photoconductive layer.

The photoconductive layer used in xerography may comprise a homogeneous layer of a single material such as vitreous selenium or polyvinyl carbazole sensitized with 2,4,7-trinitro-9-fluorenone (TNF); or it may be a composite layer of two or more phases in which a photoconductor is combined with another material. One example of a composite structure comprises a binder layer of finely divided photoconductive particles dispersed in a filmforming electrically insulating organic resin binder. In some cases, a photoconductive material is substituted for the resin binder.

When exposed to imaging light, charge transport in homogeneous photoconductive layers is accomplished by the charge being transported through the bulk of the photoconductive layer such as in the case of vitreous selenium and other homogeneous photoconductive layers. In photoconductive binder layers, charge transport is accomplished through the use of high photoconductor loadings allowig for particle-to-particle contact within the resin binder layer. In the case where photoconductive particles are dispersed in a photoconductive matrix, photoconductivity occurs through the generation of charge carriers in both the photoconductive matrix and the photoconductive pigment particles.

The above photoconductive layers suffer from one common deficiency in that the photoconductive surface during operation is exposed to the surrounding environment, and particularly in the case of cycling xerography, are susceptible to abrasion, chemical attack, heat and multiple exposures to light during cycling. These effects are characterized by a gradual deterioration of the electrical characteristics of the photoconductive layer resulting in the printing out of surface defects and scratches, localized areas of persistent conductivity which fail to retain an electrostatic charge, and high dark discharge.

In addition to the problems noted above, these photoconductive layers require that the photoconductor comprise either 100 percent of the layer, as in the case of a vitreous selenium layer, or that they preferably contain a high proportion of photoconductive material in the form of pigment in the binder configuration. The requirement that the photoconductive layer contain all or a major portion of a photoconductive material further restricts the physical characteristics of the final photoreceptor member in that the physical characteristics, such as flexibility and adhesion of the photoconductive layer to the supporting substrate, are primarily dictated by the physical properties of the photoconductor, and not by the resin or matrix material which is usually present in a minor amount.

In order to overcome the above deficiencies of the prior art, U.S. patent applications D/3279I Ser. No. 371,647, filed June 20, 1973 and D/3421I Ser. No. 341,839 filed Mar. 16, 1973 were filed, directed to a composite layered configuration in which a photoconductive or photogenerating layer contained on a conductive substrate is overlayed with an electrically active organic overlayed material which effectively seals the photogenerating or photoconductive layer from ambient conditions. These structures are limited to transparent electrically active organic overlayers when used in conjunction with an opaque substrate. U.S. Pat. No. 3,573,906 discloses another composite imaging device which in one embodiment defines a structure which includes an active layer of PVK contained on a substrate with a thin layer of vitreous selenium as the top layer. With the selenium on top, this device fails to provide adequate mechanical properties, such as resistance to abrasion during repetitive use.

The present invention is directed to an improvement on structures described above in which the charge generation and charge transport functions are separated for greater electrical efficiency, and in which two electrically organic active layers effectively protect the photogenerating layer from ambient conditions. The invention also provides a novel photosensitive device which is capable of cyclic imaging when either or both of the electrically active organic materials are substantially light absorbing in the visible.

OBJECTS OF THE INVENTION

It is therefore an object of this invention to provide a novel photosensitive device capable for use in cyclic imaging.

It is another object of this invention to provide a novel photosensitive layered device.

It is another object of this invention to provide a novel photosensitive device which is capable of exhibiting outstanding mechanical properties.

It is a further object of this invention to provide a photosensitive member which exhibits efficient hole and electron photogeneration and transport.

SUMMARY OF THE INVENTION

The present invention is directed to a three-layered composite photoreceptor device. The device comprises a photogenerator or photoconductive layer sandwiched between two electrically active layers. In one embodiment, the photoconductive layer is sandwiched or laminated between a positive or hole transport layer on one side and an electron or negative transport layer on the other side. This device offers the advantage in that any photogenerating layer may be used in that the photogenerating layer is completely shielded on both sides from abrasion and ambient conditions. The device also removes adhesion constraints from the generator layer in that the generator layer is not in contact with the substrate. Further, the structure may be charged either positively or negatively depending upon whether the top layer is an electron or hole transport layer.

In one embodiment of the present invention, an amorphous or trigonal selenium photogenerating layer is sandwiched between an electron transporting material such as a complex of PVK/TNF or TNF alone; and a layer of hole transport material such as PVK or PVP.

When TNF is used, it is preferably blended with an inactive polymeric material in order to enhance the mechanical properties of the layer. This configuration is suitable for use in xerographic imaging with positive charging. If the position of the transport layers are reversed, the device then becomes suitable for use with negative charging.

DETAILED DESCRIPTION OF THE INVENTION

Figure 1:
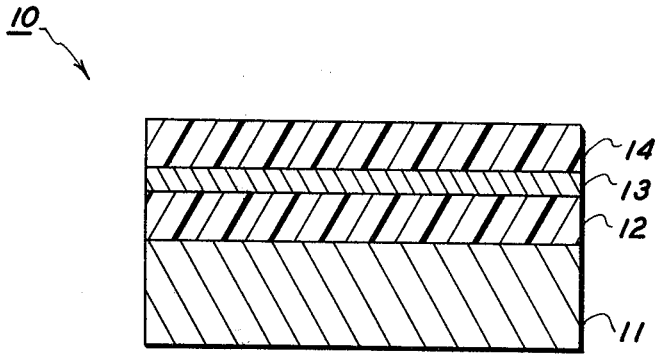
FIG. 1 is a schematic illustration of one embodiment of an imaging member of the present invention.

As defined herein, a photoconductor is a material which is electrically photoresponsive to light in the wavelength region in which it is to be used. More specifically, it is a material whose electrical conductivity increases significantly in response to the absorption of electromagnetic radiation in the wavelength region in which it is to be used. This definition is necessitated by the fact that a vast number of organic compounds are known or expected to be photoconductive when irradiated with strongly absorbed ultraviolet, x-ray, or gamma-radiation. Photoconductivity in organic materials is a common phenomenon. Practically all highly conjugated organic compounds exhibit some degree of photoconductivity under appropriate conditions. Many of these organic materials have their prime wavelength response in the ultraviolet. However, little commercial utility has been found for ultraviolet responsive materials, and their short wavelength response is not particularly suitable for document copying or color reproduction. In view of the general prevalence of photoconductivity in organic compounds following short wavelength excitation, it is therefore necessary that for the instant invention, the term "photoconductor" or "photoconductive" be understood to include only those materials which are in fact photoresponsive in the wavelength region in which they are to be used.

The active material, which is also referred to as the active matrix material when used as a matrix for a binder layer, is a substantially non-photoconductive material which supports an injection efficiency of photo-excited holes from the photoconductive layer of at least about 10 percent at fields of about $2 \times 10^5$ volts/cm. This material is further characterized by the ability to transport the carrier at least $10^{-3}$ cm. at a field of no more than about $10^6$ volts/cm. In addition, the active material is substantially transparent in the wavelength region in which the device is to be used.

The active transport material which is employed in conjunction with the photoconductive layer of the present invention is a material which is an insulator to the extent that an electrostatic charge placed on said active binder material is not conducted in the absence of illumination at a rate sufficient to prevent the formation and retention of an electrostatic latent image thereon. In general, this means that the specific resistivity of the active transport material should be at least about $10^{10}$ ohms-cm.

As can be seen from the above discussion, most materials which are useful for active layers of the instant invention are incidentally also photoconductive when radiation of wavelengths suitable for electronic excitation is absorbed by them. However, photoresponse in the short wavelength region, which falls outside the spectral region for which the photoconductor is to be used, is irrelevant to the performance of the device. It is well known that radiation must be absorbed in order to excite photoconductive response, and the transparency criteria stated above for the active materials implies that these materials do not contribute significantly to the photoresponse of the photoreceptor in the wavelength region of use.

The reason for the requirement that the active materials must be transparent is based upon the discovery that under all practical conditions, the efficiency of photoinjection from the photoconductor into the active materials for visible radiation absorbed by the photoconductor far exceeds the intrinsic photosensitivity of the active material in any wavelength region - visible or otherwise.

It is not the intent of this invention to restrict the choice of active materials to those which are transparent in the entire visible region. For example, with a thin non-transparent electrically active organic overlayer, imagewise exposure may be accomplished in the normal manner. With a thicker active layer and a transparent substrate, imagewise exposure may be accomplished through the substrate without the light having to pass through a top layer of an active material. In this case, the active material need not be non-absorbing in the wavelength region of use. Other applications where complete transparency is not required for the active material in the visible region include the selective recording of narrow-band radiation such as that emitted from lasers, spectral pattern recognition, and possible functional color xerography such as color coded form duplication.

DETAILED DESCRIPTION OF THE DRAWINGS

Referring to FIG. 1, reference character 10 designates an imaging member in the form of a plate which comprises a supporting substrate 11 having a layer of organic charge transport layer 12 thereon, a photoconductive layer 13 overlays transport layer 12, and a second organic charge transport layer 14 overlays photoconductive layer 13.

Substrate 11 is preferably made up of any suitable conductive material. Typical conductors comprise aluminum, stainless steel, nickel, brass or the like. The substrate may be rigid or flexible and of any convenient thickness. Typical substrates include endless flexible belts or sleeves, sheets, webs, plates, cylinders, and drums. The substrate or support may also comprise a composite structure such as a thin conductive coating contained on a paper base; a plastic coated with a thin conductive layer such as aluminum or copper iodide; or glass coated with a thin conductive coating of chromium or tin oxide. In some cases, the substrate may be dispensed with entirely and the imaging member made up of only the three top layers. In this case, the imaging member may be placed upon a conductive platen during the charging and exposure steps or optionally charged on either side with two corona charging devices to opposite polarities.

In one embodiment of the present invention, active layer 12 may comprise any suitable transparent organic polymer or non-polymeric material capable of supporting the injection of photo-excited holes from the photoconductive layer and allowing the transport of these holes through the organic layer to selectively discharge a charge of opposite polarity at the substrate interface.

Polymers having this characteristic have been found to contain repeating units of a polynuclear aromatic hydrocarbon which may also contain heteroatoms such as, for example, nitrogen, oxygen, or sulfur. Typical polymers include poly-N-vinyl carbazole (PVK), poly-1-vinyl pyrene (PVP), poly-9-vinyl anthracene, polyacenaphthalene, poly-9-(4-pentenyl)-carbazole, poly-9-(5-hexyl)-carbazole, polymethylene pyrene, poly-1-(- pyrenyl)-butadiene and N-substituted polymeric acrylic acid amides of pyrene. Also included are derivatives of such polymers including alkyl, nitro, amino, halogen, and hydroxy substituted polymers. Typical examples are poly-3-amino carbazole, 1,3-dibromo-poly-N-vinyl carbazole and 3,6-dibromo-poly-N-vinyl carbazole in particular derivatives of the formula

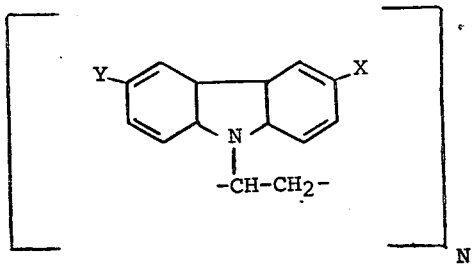

where X and Y are substituents and N is an integer. Also included are structural isomers of these polymers, typical examples include poly-N-vinyl carbazole, poly-2-vinyl carbazole and poly-3-vinyl carbazole. Also included are co-polymers; typical examples are N-vinyl carbazole/methyl acrylate co-polymer and 1-vinyl pyrene/butadiene ABA, and AB block polymers. Typical non-polymeric materials include carbazole, N-ethylcarbazole, N-phenylcarbazole, pyrene, tetraphene, 1-acetylpyrene, 2,3-benzochrysene, 6,7-benzopyrene, 1-bromopyrene, 1-ethylpyrene, 1-methylpyrene, perylene, 2-phenylindole, tetracene, picene, 1,3,6,8-tetraphenylpyrene, chrysene, fluorene, fluorenone, phenanthrene, triphenylene, 1,2,5,6-dibenzanthracene, 1,2,3,4-dibenzanthracene, 2,3-benzopyrene, anthraquinone, dibenzothiophene, and naphthalene and 1-phenylnaphthalene. Due to the poor mechanical properties of the non-polymer materials, they are preferably used in conjunction with either an active polymeric material or a non-active polymeric binder. Typical examples include suitable mixtures of carbazole in poly-N-vinyl carbazole as an active polymer and carbazole in a non-active binder. Such non-active binder materials include polycarbonates, acrylate polymers, polyamides, polyesters, polyurethanes, and cellulose polymers.

It should be understood that the use of any polymer (a polymer being a large molecule built up by the repetition of small, simple chemical units) whose repeat unit contains the appropriate aromatic hydrocarbon, such a carbazole, and which supports hole injection and transport, may be used. It is not the intent of the invention to restrict the type of polymer which can be employed as the transport layer. Polyesters, polysiloxanes, polyamides, polyurethanes and epoxies as well as block, random or graft co-polymers (containing the aromatic repeat unit) are exemplary of the various types of polymers which can be employed as the active material. In addition, suitable mixtures of active polymers with inactive polymers or non-polymeric materials may be employed. One action of certain non-active material is to act as a plasticizer to improve the mechanical properties of the active polymer layer. Typical plasticizers include epoxy resins, polyester resins, polycarbonate resins, 1-phenyl naphthalene and chlorinated diphenyl.

The active layer not only serves to transport holes, but also protects the photoconductive layer from unwanted charge injection from the substrate. In general, the thickness of active layer 12 should be from about 1 to 100 microns, but thicknesses outside this range can also be used.

Alternatively, active layer 12 may comprise an electron transport material of the type described for layer 14. In this instance, layer 14 would then normally consist of a hole transport material, such as those listed as suitable materials for layer 12.

Photoconductive layer 13 may comprise any suitable inorganic or organic material or mixtures thereof. The layer may comprise any suitable structure known to the art such as a substantially homogeneous layer of photoconductive material or any suitable composite structure such as a binder configuration in which finely divided photoconductive particles are dispersed in a binder matrix material.

When using a binder configuration, photoconductive particles are dispersed randomly without orientation in a matrix material. The photoconductive particles may consist of any suitable inorganic or organic photoconductor and mixtures thereof. Inorganic materials include inorganic crystalline compounds such as cadmium sulfoselenide, cadmium selenide, cadmium sulfide, and mixtures thereof. Typical inorganic photoconductive glasses include amorphous selenium, and selenium alloys such as seleniumtellurium, and selenium-arsenic. Selenium may also be used in a crystalline form known as trigonal selenium. Typical organic photoconductive materials include phthalocyanine described in U.S. Pat. No. 3,357,989 to Byrne et al. The above list of photoconductors should in no way be taken as limiting, but is merely illustrative of suitable materials.

The binder material may comprise any suitable film forming organic resin, an electrically active organic material, or a photoconductive material.

In another embodiment of the instant invention, the binder structure is modified to insure that the photoconductive particles are in the form of continuous chains through the thickness of the binder layer. This type of photoconductive layer is more fully described in U.S. Pat. No. 3,787,208, which is incorporated herein by reference.

Alternatively, the photoconductive layer may consist entirely of a substantially homogeneous photoconductive material such as a layer of amorphous selenium, a selenium alloy, trigonal selenium or a powdered or sintered photoconductive layer such as a cadmium sulfoselenide or phthalocyanine.

The thickness of the photoconductive layer is generally not critical. Layer thicknesses of from about 0.05 to 20 microns have been found satisfactory, with a preferred thickness of about 0.2 to 5 microns exhibiting good results. When using trigonal selenium, however, the layer thickness should be maintained in a range of about 0.03–0.8 in order to avoid a degradation in the electrical characteristics.

Reference character 14 comprises an active transport material layer which overlays the photoconductive layer 13. In one embodiment of the invention, active transport layer 14 comprises an electron transport material which is capable of both supporting electron injection from the photoconductive layer and transporting said photogenerated electrons under the influence of an applied field. In order to function in the manner outlined above for one embodiment of the invention, the active transport material should be substantially transparent to the particular wavelength region used for xerographic copying. In particular, the active transport material should be substantially non-absorbing in at least a significant portion that part of the electromagnetic spectrum which ranges from about 4200 to 8000 Angstroms because most xerographically useful photoconductors have photoresponse to wavelengths in this region.

As mentioned above, the above transport layer 14 comprises aromatic or heterocyclic electron acceptor materials which have been found to exhibit negative charge carrier transport properties as well as the requisite transparency characteristics. Typical electron acceptor materials included within the scope of the instant invention include phthalic anhydride, tetrachlorophthalic anhydride, benzil, mellitic anhydride, S-tricyanobenzene, picryl chloride, 2,4-dinitrochlorobenzene, 2,4-dinitrobromobenzene, 4-nitrobiphenyl, 4,4-dinitrobiphenyl, 2,4,6-trinitroanisole, trichlorotrinitrobenzene, trinitro-o-toulene. 4,6-dichloro-1,3-dinitrobenzene, 4,6-dibromo-1,3-dinitrobenzene, P-dinitrobenze, chloranil, bromanil, and mixtures thereof. It is further intended to include within the scope of those materials suitable for use in active transport layer 14, other reasonable structural or chemical modifications of the above-described materials provided that the modified compound exhibits the desired charge carrier transport characteristics.

While any and all aromatic or heterocyclic electron acceptors having the requisite transparency characteristic are within the purview of the instant invention, particularly good electron transport properties are found with aromatic or heterocyclic compounds having more than one substituent of the strong electron withdrawing substituents such as nitro-(—$NO_2$), sulfonate ion (—$SO_3$), carboxyl-(—COOH) and cyano-(CH) groupings. From this class of materials, 2,4,7-trinitro-9-fluorenone (TNF), 2,4,5,7-tetranitrofluorenone, trinitroanthracene, dinitroacridene, tetracyanopyrene, and dinitroanthraquinone are preferred materials because of their availability and superior electron transport properties.

It will be obvious to those skilled in the art that the use of any polymer having the described aromatic or heterocyclic electron acceptor moiety as an integral portion of the polymer structure will function as an active transport material. It is not the intent of the invention to restrict the type of polymer which can be employed as the transport material, provided it has an active electron acceptor moiety to provide the polymer with electron transport characteristics. Polyesters, polysiloxanes, polyamides, polyurethanes, and epoxies, as well as block, random or graft copolymers containing the aromatic moiety are therefore exemplary of the various types of polymers which could be employed. In addition, electronically inactive polymers in which the active electron acceptor or material is dispersed at high concentration can be employed as hereinafter described.

In another embodiment of the present invention, layers 12 and 14 may each comprise an active material capable of transporting both holes and electrons. One material which is suitable for this embodiment comprises a complex of PVK and TNF. A satisfactory concentration for the TNF is about 1 to 15 weight percent, with the balance comprising PVK.

The substantial or significant transparency of the active transport material within the context of the instant invention, as exemplified by FIG. 1, means that a sufficient amount of radiation from a source must pass through the active transport layer 14 in order that the photoconductive layer 13 can function in its capacity as a photogenerator and injector of electrons. More specifically, substantial transparency is present in the active transport materials of the present invention when the active transport material is non-photoconductive and non-absorbing in at least some significant portion of the wavelength region of from about 4200 to 8000 Angstrom Units. This property of substantial transparency enables enough activating radiation to impinge the photoconductor layer so as to cause discharge of the charged active transport photoreceptor of the present invention.

It is not the intent of this invention to strictly restrict the choice of active transport materials to those which are transparent in the entire visible region. For example, with a thin, nontransparent electrically active organic overlayer material, imagewise exposure may be accomplished in the normal manner. With a thicker active layer, and a transparent substrate, and substantially transparent active layer 12, imagewise exposure may be accomplished through the substrate without the light passing through the layer of active transport material. In this case, the active material need not be non-absorbing in the wavelength region of use. This particular application takes advantage of the injection and transport properties of the present active materials and falls within the purview of the instant invention. Other applications where complete transparency is not required for the active material include the selective recording of narrowband radiation such as that emitted from lasers, spectral pattern recognition, color coded form duplication, and possibly color xerography.

While the active material layer 14 of FIG. 1 may consist exclusively of charge transport material, for purposes of the present invention, the layer may also comprise the charge transport material at a sufficient concentration in a suitable electronically inert binder material to effect particle-to-particle contact or to effect sufficient proximity thereby permitting effective charge transport from the photoinjecting pigments of the instant invention through the layer. Generally, there must be a volume ratio of at least 25 percent active transport material to electronically inert binder material to obtain the desired particle-to-particle contact or proximity. Since one of the active matrix layers may be made somewhat thin, while the other is made correspondingly thicker, the capacitive split, and hence electric field experienced by each layer will enable progressively less transport material in the inert binder for satisfactory transport properties. Typical resin binder materials for the practice of the invention are polystyrene; silicone resins such as DC-801, DC-804, and DC-996 all manufactured by the Dow Corning Corporation; and Lexan, a polycarbonate resin, SR-82 manufactured by the General Electric Company; acrylic and methacrylic ester polymers such as Acryloid A10 and Acryloid B72, polymerized ester derivatives of acrylic and alpha-acrylic acids both supplied by Rohm and Haas Company and Lucite 44, Lucite 45 and Lucite 46 polymerized butyl methacrylates supplied by the E. I. duPont de Nemours & Company; chlorinated rubber such as Parlson supplied by the Hercules Powder Company; vinyl polymers and copolymers such as polyvinyl chloride, polyvinyl acetate, etc. including Vinylite VYHH and VMCH manufactured by the Bakelite Corporation; cellulose esters and ethers such as ethyl cellulose, nitrocellulose, etc.; alkyd resins such as Glyptal 2469 manufactured by the General Electric Company, etc.; and polyester resins such as those available from Goodyear under the tradename Flexclad. In addition, mixture of such resins with each other or with plasticizers so as to improve adhesion, flexibility, blocking, etc. of the coatings may be used. Thus, Rezyl 869 (a linseed oil-glycerol alkyd manufactured by American Cyanamid Company) may be added to chlorinated rubber to improve its adhesion and flexibility. Similarly, Vinylites VYHH and VMCH (polyvinyl chloride-acetate copolymers manufactured by the Bakelite Company) may be blended together. Plasticizers include phthalates, phosphates, adipates, etc. such as tricresyl phosphate, dicotyl phthalate, etc. as is well known to those skilled in the art.

The active transport material which is employed in conjunction with the photoconductive layer in the instant invention is a material which is an insulator to the extent that an electrostatic charge placed on said active transport material is not conducted in the absence of illumination at a rate sufficient to prevent the formation and retention of an electrostatic latent image thereon. In general, this means that the specific resistivity of the active transport material should be at least $10^{10}$ ohms-cm. and preferably will be several orders higher. For optimum results, however, it is preferred that this specific resistivity of the active transport material be such that the overall resistivity of the active binder layer in the absence of activating illumination or charge injection from an adjacent layer be about $10^{12}$ ohms-cm.

Because the overlayer functions as an active transport layer, thickness is not critical to the function of the xerographic member. However, the thickness of said active transport layer would be dictated by practical needs in terms of the amounts of electrostatic charge necessary to induce an applied field suitable to effect electron injection and transport. Therefore, the thicknesses of layers 12 and 14 may be varied at will to obtain the desired electric fields for the most efficient charge transport in both active matrix materials. Active transport layer thicknesses may vary from about 1 to 100 microns, but thicknesses outside this range may also be used.

In another embodiment of the present invention, the requirement for transparency of both layers is modified to the extent that the active layer through which imaging light is passing should be substantially transparent, but transparency for the layer through which light is not passing is not a requirement. It should also be understood that the thickness of active layers may be varied to any desired degree in order to control the mechanical and electrical properties of the device.

In another embodiment of the present invention, the requirement for transparency of both layers is lifted to the extent that the active layer through which imaging light is passing may be made sufficiently thin to allow imagewise exposure in the normal manner or through a transparent substrate.

As stated above, in an alternative embodiment of the present invention, active layers 12 and 14 may comprise a material such as a blend of PVK and TNF which would transport charge carriers of both polarities, i.e., both holes and electrons. In this case, the structure may be charged positive or negative without the requirement of active layer interchange. The only limitation on this embodiment is that one side of the sandwich be thin enough to allow imagewise exposure in the normal manner or through a transparent substrate.

Figure 2:
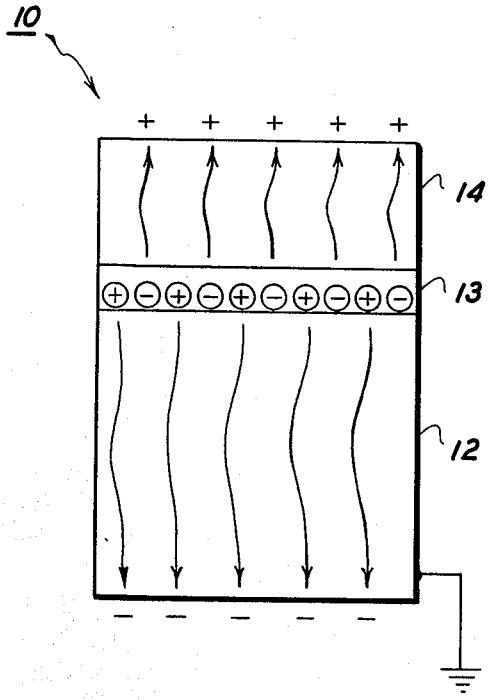
FIG. 2 schematically illustrates the mechanism of charge generation and transport for the embodiment of FIG. 1.

FIG. 2 illustrates schematically, the charge generation and transport mechanism for one embodiment of the present invention. In FIG. 2, imaging radiation to which the top transport layer is transparent, strikes the photoconductive or charge generating layer generating electron hole pairs which are injected into and transported through the adjacent hole and electron transport layers, respectively. In the embodiment illustrated in FIG. 2, the top transport layer exhibits good electron transport while the bottom transport layer exhibits preferred transport for holes. This structure, therefore, is charged positively, and upon the generation of charged carriers, the electrons selectively move to the top surface to discharge the electrostatic charge while the holes move through the bottom active layer to neutralize a corresponding balancing negative charge at the substrate interface. In an alternative embodiment, the hole transport layer may comprise the top layer and the electron transport layer may comprise the bottom layer and in this instance, the photoreceptor member would be charged to a negative polarity and the charge carriers illustrated in FIG. 2, would be reversed.

DESCRIPTION OF THE PREFERRED EMBODIMENTS

The following Examples further specifically define the present invention with respect to a method of making a photosensitive member containing a photoconductive layer sandwiched between two active organic layers. The percentages are by weight unless otherwise indicated. The Examples below are intended to illustrate various preferred embodiments of the instant invention.

EXAMPLE I

A photosensitive layered structure similar to that illustrated in FIG. 1 consisting of an aluminized Mylar substrate, having a 14 micron layer of polyvinyl carbazole over the substrate, a 1 micron layer of amorphous selenium over the PVK layer, and a 3 micron layer of TNF/polyester as a top layer is prepared by the following technique:

1. A 12% polymer stock solution is prepared by dissolving the appropriate amount of poly-N-carbazole (PVK), Luvican M170 grade, available from BASF, in a solution chloroform. A 14 micron layer of PVK is formed by applying the stock solution of PVK to an aluminized Myler substrate using a Bird applicator. The coating is then dried at 100°C for 16 hours.

2. A 1 micron layer of vitreous selenium is formed over the PVK layer by conventional vacuum deposition techniques such as those disclosed by Bixby in U.S. Pats. Nos. 2,753,278 and 2,970,906.

3. A stock solution containing 1 gram of 2,4,7-trinitro-9-fluorenone (TNF) and 1 gram of a polyester resin is made by dissolving the TNF and polyester in a solution of 66 ml. of chloroform. This solution was then evaporated at 60°C to half its volume or about 35 ml. This TNF/polyester solution is coated over the vitreous selenium layer to form a dried layer thickness of about 3 microns thick.

EXAMPLE II

A second plate is made by the method of Example I except that the TNF/polyester layer is formed adjacent the substrate with the selenium layer on top and the PVK layer formed last as the top layer.

The plates of Example I and II are tested electrically by charging the plates to fields of 33 and 55 volts/micron, respectively, and discharged at a wavelength of 4200 A at $2 \times 10^{12}$ photons/cm$^2$/sec. The plates exhibit satisfactory discharge at both fields and are capable for use in forming visible images. The plate of Example I was further tested by repeating the above described electrical test 50 times at both fields, and continued to exhibit satisfactory discharge characteristics after 50 cycles.

As can be seen from above, any photogenerating layer may be used with the two active matrix layers of the above plates. The photogenerating layer is completely shielded from the ambient and substrate by sandwiching it between the two electrically active charge transport layers. Depending upon which active layer is used at the top layer, the structure can be made to accept positive charge or negative charge as desired. In addition, the structure exhibits excellent electrical blocking contacts both at the top and bottom and is suitable for use in cyclic imaging.

Other modifications and ramifications of the present invention would appear to those skilled in the art upon reading the disclosure. These are also intended to be within the scope of the present invention.

What is claimed is:

1. A method of imaging which comprises:

a. providing an imaging member comprising a first layer of electrically active charge transport material contained on a supporting substrate, a photoconductive layer overlying said active layer, and a second layer of electrically active charge transport material overlying said photoconductive layer, one of said electrically active layers exhibits the capability of facile hole injection and transport and the other electrically active layer exhibits the capability of facile electron injection and transport;

b. electrostatically charging said member; followed by c. exposing said member to a pattern of activating radiation which results in the generation of electron hole pairs by the photoconductive layer, said holes being injected into and transported through said active layer capable of facile hole injection and transport and said electrons being injected into and transported through said active layer capable of facile electron injection and transport, resulting in the formation of a latent electrostatic image.

2. The method of claim 1 which further includes developing the latent electrostatic image to form a visible image.

3. An imaging member comprising a first layer of electrically active charge transport material contained on a supporting substrate, a photoconductive layer overlying said active layer, and a second layer of electrically active charge transport material overlying said photoconductive layer, one of said electrically active layers exhibits the capability of facile hole injection and transport and the other electrically active layer exhibits the capability of facile electron injection and transport.

4. The member of claim 1 in which one of said electrically active layers comprises 2,4,7-trinitro-9-fluorenone blended with a minor proportion of an electrically insulating polymeric material and the other electrically active layer comprises polyvinyl carbazole.

5. The member of claim 1 in which said first active layer comprises 2,4,7-trinitro-9-fluorenone blended with a minor proportion of an electrically insulating polymeric material and said second active layer comprises polyvinyl carbazole.

6. The member of claim 1 in which said first active layer comprises polyvinyl carbazole and said second active layer comprises 2,4,7-trinitro-9-fluorenone blended with a minor proportion of an electrically insulating polymeric material.

7. An imaging member comprising a first layer of electrically active charge transport material contained on a supporting substrate, a photoconductive layer overlying said active layer, and a second layer of electrically active charge transport material overlying said photoconductive layer, with both of said active layers exhibiting the capability of both facile electron and hole injection and transport.

8. The member of claim 7 in which both of the active layers comprise a complex of polyvinyl carbazole and 2,4,7-trinitro-9-fluorenone.

* * * * *

UNITED STATES PATENT AND TRADEMARK OFFICE

CERTIFICATE OF CORRECTION

PATENT NO. : 3,953,207

DATED : April 27, 1976

INVENTOR(S) : Anthony M. Horgan

It is certified that error appears in the above-identified patent and that said Letters Patent are hereby corrected as shown below:

Column 1, line 28, delete "filmforming" and insert --film-forming--.

Column 1, line 38, delete "allowig" and insert --allowing--.

Column 6, line 36, delete "seleniumtellurium" and insert --selenium-tellurium--.

Column 7, line 17, delete "above", second occurrence and insert - - active --

Column 7, line 28, delete the period "." and insert a comma --,--.

Column 8, line 42, delete "narrowband" and insert --narrow-band--.

Column 10, line 61, delete "Myler" and insert --Mylar--.

Signed and Sealed this

Twenty-first Day of September 1976

[SEAL]

*Attest:*

RUTH C. MASON
*Attesting Officer*

C. MARSHALL DANN
*Commissioner of Patents and Trademarks*